United States Patent [19]

Bohg et al.

[11] 4,302,700

[45] Nov. 24, 1981

[54] ELECTRODE GUIDE FOR METAL PAPER PRINTERS

[75] Inventors: Armin Bohg, Neuweiler; Kurt Hartmann, Calw-Heumaden, both of Fed. Rep. of Germany

[73] Assignee: International Business Machines Corporation, Armonk, N.Y.

[21] Appl. No.: 101,359

[22] Filed: Dec. 7, 1979

[30] Foreign Application Priority Data

May 21, 1979 [DE] Fed. Rep. of Germany ..... 2920569

[51] Int. Cl.[3] ..... H01J 1/88; H01J 19/42; H01K 1/18

[52] U.S. Cl. ..... 313/292; 55/140; 101/93.05; 250/324; 313/289; 346/139 C

[58] Field of Search ..... 313/302, 309, 292, 259, 313/289; 250/324, 325, 326; 55/140, 141, 155; 156/662; 101/93.05; 346/139 C

[56] References Cited

U.S. PATENT DOCUMENTS

| | | | |
|---|---|---|---|
| 2,239,695 | 4/1941 | Bennett | 313/309 X |
| 2,983,847 | 5/1961 | Spengler | 313/309 |
| 3,789,278 | 1/1974 | Bingham et al. | 250/326 |
| 3,814,968 | 6/1974 | Nathanson et al. | 313/309 |
| 3,965,479 | 6/1976 | Sakamoto et al. | 346/139 C |
| 3,970,887 | 7/1976 | Smith et al. | 313/309 |
| 3,998,678 | 12/1976 | Fukase et al. | 313/309 |
| 4,008,412 | 2/1977 | Yuito et al. | 313/309 |
| 4,141,661 | 2/1979 | Geis et al. | 101/93.05 |
| 4,180,333 | 12/1979 | Linder | 101/93.05 |
| 4,191,788 | 3/1980 | Harrington | 156/622 |

FOREIGN PATENT DOCUMENTS

| | | | |
|---|---|---|---|
| 2156360 | 5/1973 | Fed. Rep. of Germany | 313/309 |

*Primary Examiner*—Saxfield Chatmon, Jr.
*Attorney, Agent, or Firm*—Kenneth P. Johnson

[57] ABSTRACT

Guide for electrodes in a metal paper printer in which V-shaped grooves are formed in monocrystalline silicon by crystallographic etching and the guide is thereafter coated with a glass passivation layer.

4 Claims, 3 Drawing Figures

ELECTRODE GUIDE FOR METAL PAPER PRINTERS

BACKGROUND OF THE INVENTION

The invention relates to an electrode guide for metal paper printers.

The electrodes of a metal paper printer are exposed to wear. They therefore have to be of such a nature that they can be advanced. In such advance, the electrodes are guided in a manner corresponding to their respective spacing.

Various possible designs of such guide parts are known. German Offenlegungsschrift 26 52 033 describes, e.g. in FIG. 2, a guide part where the electrodes are guided in small glass tubes cast in a block of synthetic material.

Furthermore, an arrangement with a guide part has been suggested (U.S. patent application Ser. No. 051,770, filed June 25, 1979) where the electrodes are arranged in grooves of a guide part which are made mechanically.

The above specified possibilities have the disadvantage that for metal paper printers of maximum printing resolution the consequently small manufacturing tolerances of the electrode guides are difficult or even impossible to maintain with conventional processing methods.

OBJECT AND SUMMARY OF THE INVENTION

It is therefore the object of the invention to provide a guide part for metal paper printer electrodes where the spacing of the individual electrode guides shows a very small tolerance.

This object of the invention is advantageously achieved by the method of the so-called crystallographic etching. This method is known from semiconductor technology (e.g. from German Offenlegungsschrift OS 26 15 438). A groove made in basic silicon semiconductor material by crystallographic etching is filled with oxide in a subsequent step for effecting a dielectric insulation in integrated semiconductor circuits.

According to the invention, it is possible to minimize the spacing tolerance of the individual electrode guides to $\pm$ 1 $\mu$m.

The foregoing and other objects, features and advantages of the invention will be apparent from the following more particular description of a preferred embodiment of the invention, as illustraed in the accompanying drawing.

BRIEF DESCRIPTION OF THE DRAWING

An embodiment of the invention is shown in the drawing and will be described below. The drawing shows the following.

DESCRIPTION OF PREFERRED EMBODIMENT

Figure 2:
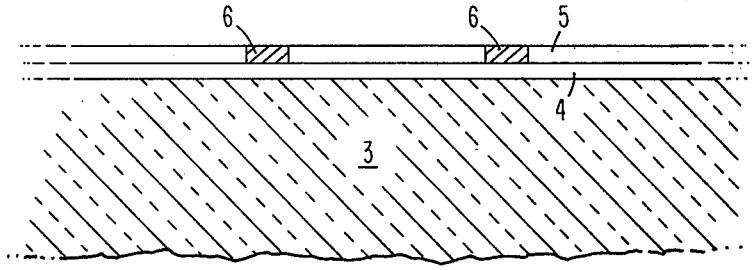
FIGS. 2 and 3 are sectional view illustrating the process of crystallographic etching for making an electrode quide in accordance with FIG. 1.
Figure 3:
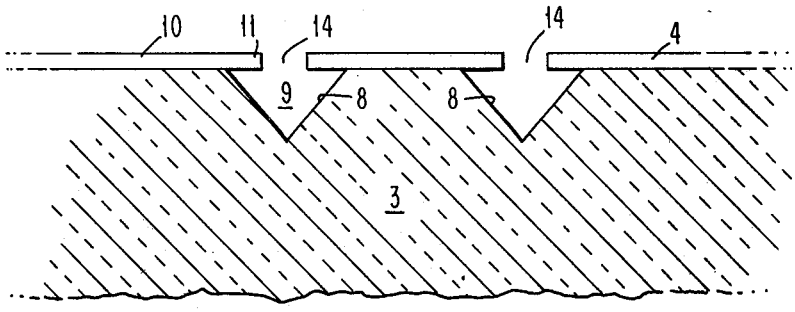

FIGS. 2 and 3 show schematic sectional views by means of which the process of crystallographic etching for making an electrode guide is to be specified. The respective starting material is a basic layer 3 of monocrystalline silicon with a 100 surface orientation. This basic layer can show a thickness of, for example, 1.5 mm. Basic silicon material 3 is coated on both sides with a protective layer 4 which can, for example, consist of $SiO_2$ or $Si_3N_4$, and with a photoresist layer 5. This photoresist layer is exposed by means of a mask that is not shown and that presents the pattern of parallel electrode grooves. The exposed parts are marked 6 in FIG. 2. An essential condition for crystallographic etching is that the exposed strip-shaped parts extend in parallel to one of the two <110> crystallographic directions in the surface.

After the removal of exposed parts 6 by means of conventional methods, windows 14 are etched into protective layer 4 with a suitable etchant, e.g. with hydrofluoric acid HF. Through these windows 14 the silicon substrate is etched off with a crystallographic etching solution, e.g. with a mixture of ethylenediamine, pyrocatechine, and water. This crystallographic etching solution is slower to attack the inclined faces 8 with a 111-crystallographic alignment than all other crystallographic directions. Thus, grooves 9 are formed with a V-shaped profile and smooth walls for the above described arrangement. The depth of the grooves is obtained substantially from the width of the window and can additionally be controlled by the etching time with a precision of $\pm$ 1 $\mu$m; the distance between the groove centers is predetermined by the exposure mask. In present day methods of mask production, spacing tolerances on the mask pattern of $\pm$1 $\mu$m can easily be ensured.

Figure 1:
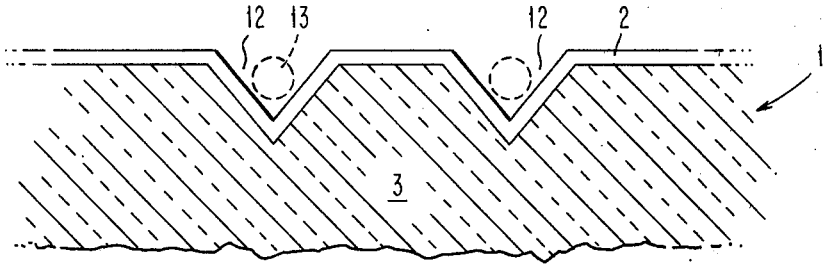
FIG. 1 is a sectional view of an electrode guide with V-shaped parallel grooves for the electrodes.

After the guide grooves have been etched off, possibly after protective layer 4 has been etched off the surface of the silicon substrate, the entire bared silicon surface is coated by thermal oxidation, cathode sputtering or chemical reaction with a glass passivation layer 2 (FIG. 1) of approximately 10 $\mu$m thickness for insulating electrodes 13 in the grooves against each other.

The grooves have an aperture angle of 70.53°. If, for example, a round tungsten wire with an 80 $\mu$m diameter is used as an electrode, the groove has to be 109 $\mu$m deep and 155 $\mu$m wide on the surface if the wire is to be flush with the surface of the guide part.

The external design of guide part 1 is achieved by grinding as with ceramic materials. In order to prevent the electrodes from sliding out of the grooves, a lid can be placed on the guide part and affixed thereto.

Such electrode guide parts can be used for the orifices of electrode print heads, as well as for intermediate electrode guides.

While the invention has been particularly shown and described with reference to a preferred embodiment thereof, it will be understood by those skilled in the art that various changes in form and details may be made therein without departing from the spirit and scope of the invention.

What is claimed is:

1. An electrode guide for a metal paper printer comprising:

a body of silicon having a plurality of parallel V-shaped grooves crystallographically etched therein, each said groove being capable of receiving an elongate wire electrode.

2. Apparatus as described in claim 1 wherein said grooved surface of said silicon guide is coated with an insulative protective layer.

3. Apparatus as described in claim 2 wherein said protective layer is a glass passivation coating.

4. Apparatus as described in claim 1 wherein said silicon body is monocrystalline silicon with a 100 surface orientation.

* * * * *